US011375864B2

(12) United States Patent
Bian et al.

(10) Patent No.: US 11,375,864 B2
(45) Date of Patent: Jul. 5, 2022

(54) VACUUM CLEANER

(71) Applicant: SKYBEST ELECTRIC APPLIANCE (SUZHOU) CO., LTD., Suzhou (CN)

(72) Inventors: Xiaoxian Bian, Suzhou (CN); Haiping Liu, Suzhou (CN); Miao Wu, Suzhou (CN)

(73) Assignee: Skybest Electric Appliance Co., Ltd., Suzhou (CN)

( * ) Notice: Subject to any disclaimer, the term of this patent is extended or adjusted under 35 U.S.C. 154(b) by 165 days.

(21) Appl. No.: 16/620,587

(22) PCT Filed: Jun. 8, 2018

(86) PCT No.: PCT/CN2018/090329
§ 371 (c)(1),
(2) Date: Dec. 9, 2019

(87) PCT Pub. No.: WO2018/224026
PCT Pub. Date: Dec. 13, 2018

(65) Prior Publication Data

US 2020/0093341 A1 Mar. 26, 2020

(30) Foreign Application Priority Data

Jun. 9, 2017 (CN) ..... 201710437533.X

(51) Int. Cl.
*A47L 9/28* (2006.01)
*A47L 9/10* (2006.01)

(52) U.S. Cl.
CPC ..... *A47L 9/2857* (2013.01); *A47L 9/102* (2013.01)

(58) Field of Classification Search
CPC ..... A47L 9/102; A47L 9/28; A47L 9/2857
See application file for complete search history.

(56) References Cited

U.S. PATENT DOCUMENTS 4,989,292 A * 2/1991 Hwang ..... A47L 5/24 15/344
9,700,187 B2 * 7/2017 Schultz ..... A47L 9/30
(Continued)

FOREIGN PATENT DOCUMENTS

CN 2785113 Y 5/2006
CN 101143080 A 3/2008
(Continued)

OTHER PUBLICATIONS

DE-102017125893-A1—English Machine Translation (Year: 2018).*
International Search Report for Application No. PCT/CN2018/090329, dated Aug. 15, 2018.

*Primary Examiner* — Marc Carlson
(74) *Attorney, Agent, or Firm* — JK Intellectual Property Law, PA

(57) ABSTRACT

A vacuum cleaner includes a head assembly including a housing and a fan arranged in the housing. A dust storage barrel and a filter assembly are arranged below the head assembly, the dust storage barrel being detachably connected to the head assembly. A switch is provided for controlling the fan located in the housing. A side wall of the housing has a cavity defined by an opening. A switch trigger is provided for turning on or turning off the switch and is located in the cavity so that no part of the switch trigger extends outwardly past an outer contour of the housing.

8 Claims, 8 Drawing Sheets

(56) References Cited

U.S. PATENT DOCUMENTS

| | | | | |
|---|---|---|---|---|
| 11,058,269 | B2 * | 7/2021 | Zhang | A47L 9/0036 |
| 2005/0055795 | A1 * | 3/2005 | Zeiler | A47L 9/009 15/353 |
| 2006/0150360 | A1 * | 7/2006 | Reick-Mitrisin | A47L 5/38 15/314 |
| 2013/0086770 | A1 * | 4/2013 | Wolfe, Jr. | H01M 50/116 15/412 |
| 2014/0215750 | A1 * | 8/2014 | Schultz | A47L 9/26 15/323 |
| 2019/0150688 | A1 * | 5/2019 | Bylund | A47L 5/14 |
| 2019/0313864 | A1 * | 10/2019 | Tahara | A47L 9/2842 |

FOREIGN PATENT DOCUMENTS

| | | | | |
|---|---|---|---|---|
| CN | 101675875 | A | 3/2010 | |
| CN | 204792550 | U | 11/2015 | |
| CN | 204829339 | U | 12/2015 | |
| CN | 205274910 | U | 6/2016 | |
| DE | 102017125893 | A1 * | 5/2018 | A47L 9/2857 |
| JP | 01285231 | A * | 11/1989 | A47L 5/24 |
| WO | WO-0124678 | A1 * | 4/2001 | A47L 9/2857 |

* cited by examiner

VACUUM CLEANER

CROSS-REFERENCE TO RELATED PATENT APPLICATIONS

This application is a national stage of International Application No. PCT/CN2018/090329, filed on Jun. 8, 2018, which claims priority to CN Patent Application No. 201710437533.X, filed on Jun. 9, 2017. All of the aforementioned applications are hereby incorporated by reference in their entireties.

TECHNICAL FIELD

The present disclosure relate to the field of cleaning, and more particularly to a vacuum cleaner.

BACKGROUND

Vacuum cleaners are widely used in the cleaning of various places. In general, a vacuum cleaner typically includes a head assembly, a filter assembly and a barrel assembly. The filter assembly is arranged in a closed space formed by the interlock of the head assembly and the barrel assembly. Generally, the outer edge of the head assembly, the outer edge of the filter assembly and the upper edge of the barrel assembly are overlapped and pressed in an axial direction, thereby effectively preventing dust from leaking out.

The existing dry or wet vacuum cleaners generally turn on or turn off a fan by a trigger switch. There are generally two types of switches: a push switch and a rotary switch. The push switch is generally arranged on the upper surface of a machine and close to the front of the machine, and the push switch has the risk of false triggering. There are also some vacuum cleaners with a rotatory switch, the rotatory switch being generally arranged in the front of the machine. The rotatory switch is not convenient to turn compared to the push switch, and the structure is relatively complex.

Therefore, it is necessary to provide an improved vacuum cleaner to solve the above problems.

SUMMARY

Technical Problem

An object of the disclosure is to provide a vacuum cleaner capable of effectively preventing the switch from false triggering.

Solutions

Technical Solutions

In order to achieve the above object, the present disclosure provides a vacuum cleaner, which comprises a head assembly, a dust storage barrel, and a filter assembly arranged below the head assembly. The dust storage barrel is detachably connected to the head assembly. The head assembly comprises a housing and a fan arranged in the housing. A switch for controlling the fan is provided in the housing. A recessed cavity is provided in the side wall of the housing. A switch trigger for turning on or turning off the switch is provided in the cavity, and any part of the switch trigger is hidden in the outer contour of the housing. The cavity comprises an opening opened in the side wall of the housing, and there is an angle between the direction in which the switch trigger is triggered to operate and the direction that the opening faces As a further improvement of the present disclosure, the housing comprises an upper cover covering the fan, and a middle cover connected between the upper cover and the dust storage barrel, and the cavity is provided between the upper cover and the middle cover.

As a further improvement of the present disclosure, the upper cover has an upper cover convex edge which is forwardly protruded, the middle cover has a middle cover convex edge which is forwardly protruded, and the cavity is formed between the upper cover convex edge and the middle cover convex edge.

As a further improvement of the present disclosure, the upper cover is provided with an air inlet, and the direction which the opening of the inlet faces is the same as the direction which the opening of the cavity faces.

As a further improvement of the prevent disclosure, the cavity has a bottom and a top opposite to the bottom, the bottom is provided with a switch seat, and the switch trigger is mounted in the switch seat.

As a further improvement of the present disclosure, the switch seat comprises a groove for receiving a part of the switch trigger, and the housing is provided with a drain hole which is communicated with the groove.

As a further improvement of the present disclosure, the switch seat is configured as a recess at the bottom of the cavity and includes an outer wall of the switch seat and an inner wall of the switch seat. The inner wall of the switch seat is configured as a through-hole of the switch seat, the switch is arranged in the through-hole, an annular gap is formed between the outer wall of the switch seat and the inner wall of the switch seat, and the side wall and end wall of the switch trigger are arranged in the annular gap.

As a further improvement of the present disclosure, the switch comprises a switch housing and a switch pin provided at the bottom of the switch housing, the switch housing is provided in the through-hole of the switch seat, the top of the switch housing is provided with an outwardly-protruding housing connection, and the housing connection is hermetically matched with the top of the inner wall of the switch seat.

As a further improvement of the present disclosure, the front side wall of the cavity is provided with a drain hole, which extends from the bottom of the cavity to the bottom of the outer wall of the switch seat and is communicated with the annular gap.

As a further improvement of the present disclosure, the dust storage barrel is provided with an air inlet, the direction which the opening of the inlet faces being the same as the direction the opening of the cavity faces.

As a further improvement of the present disclosure, the switch trigger is configured as a rocker button which is installed at the bottom of the cavity.

Beneficial Effects

The beneficial effects of the present disclosure are as follows. It can be seen from the above technical solutions that the present disclosure has many outstanding substantive technical features. After the implementation of the technical solutions of the present disclosure, significant technical progress is mainly embodied in: (1) the switch trigger is set in the recessed cavity, the operator can only operate the switch by active action, thereby avoiding the probability of false triggering of the machine, and the use of the vacuum cleaner is safer; (2) the drain hole is opened in the front side of the outer wall of the switch seat, so that the water entering the cavity can be discharged in time, and the outwardly-protruding housing connection is hermetically matched with the inner wall of the switch seat, thereby further preventing water from seeping into the electrical portion of the vacuum cleaner.

Figure 1:
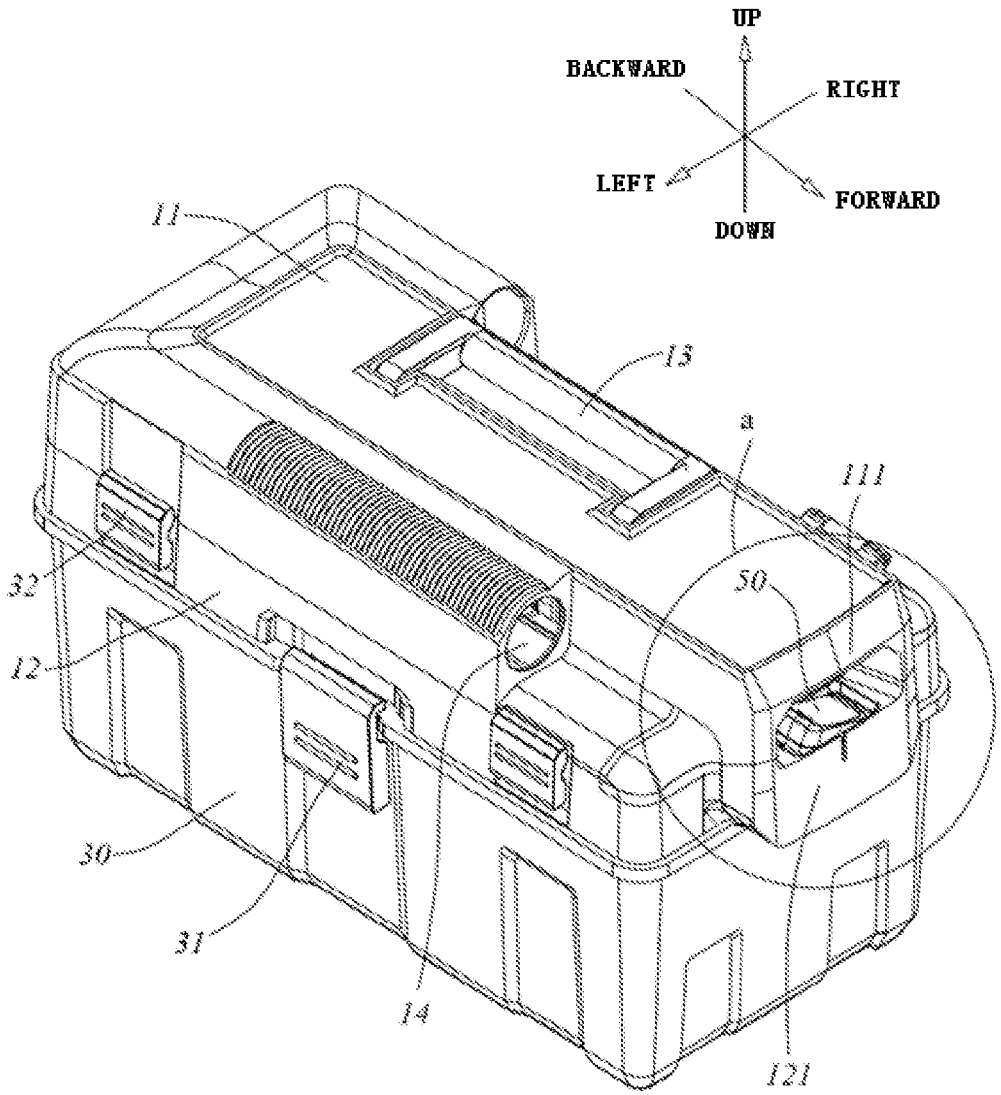
FIG. 1 is a three-dimensional schematic view of a vacuum cleaner in the first preferred embodiment of the present disclosure.
Figure 2:
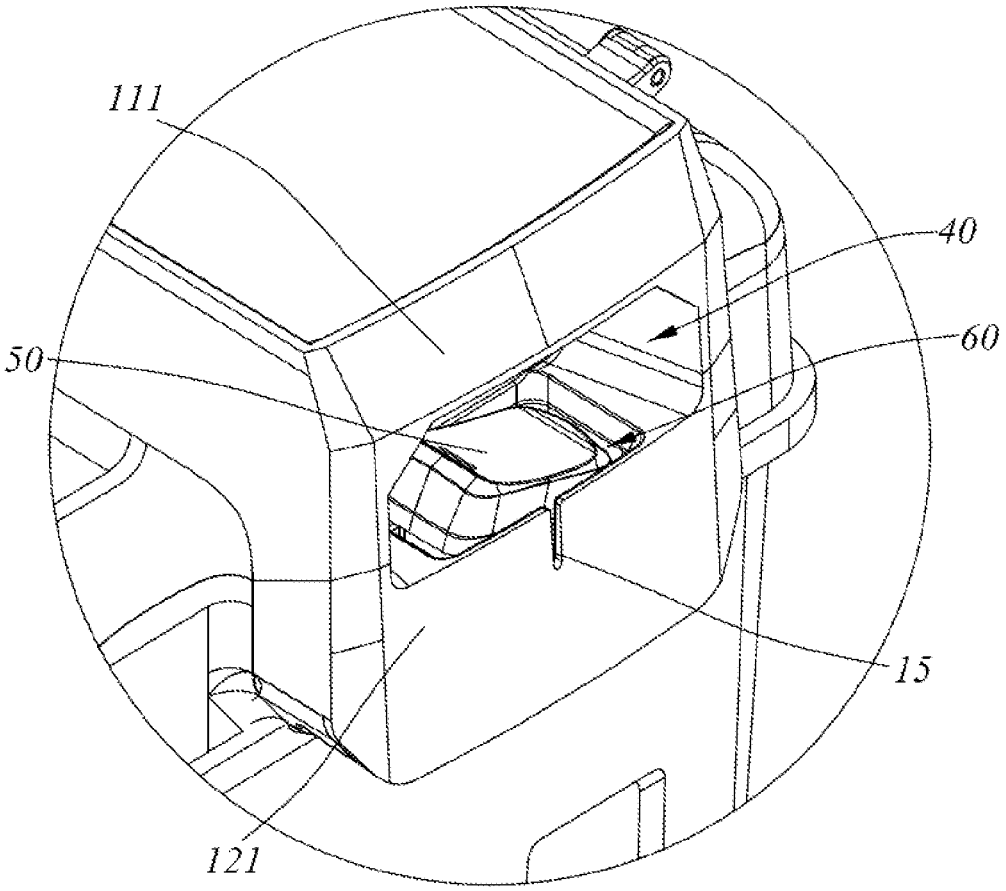
FIG. 2 is an enlarged schematic view of the portion A of the vacuum cleaner in FIG. 1.
Figure 3:
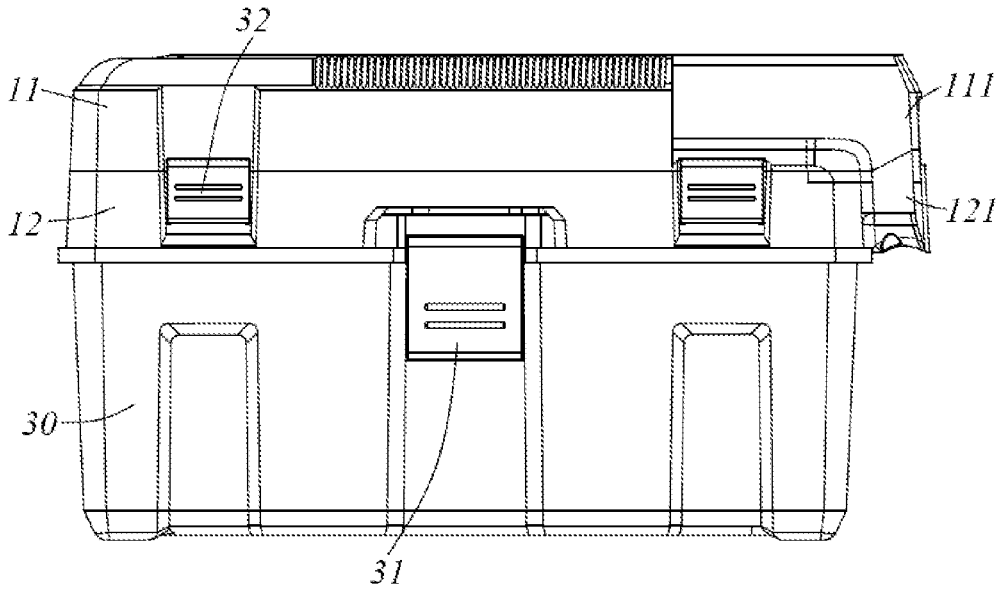
FIG. 3 is a front view of the vacuum cleaner in FIG. 1.
Figure 4:
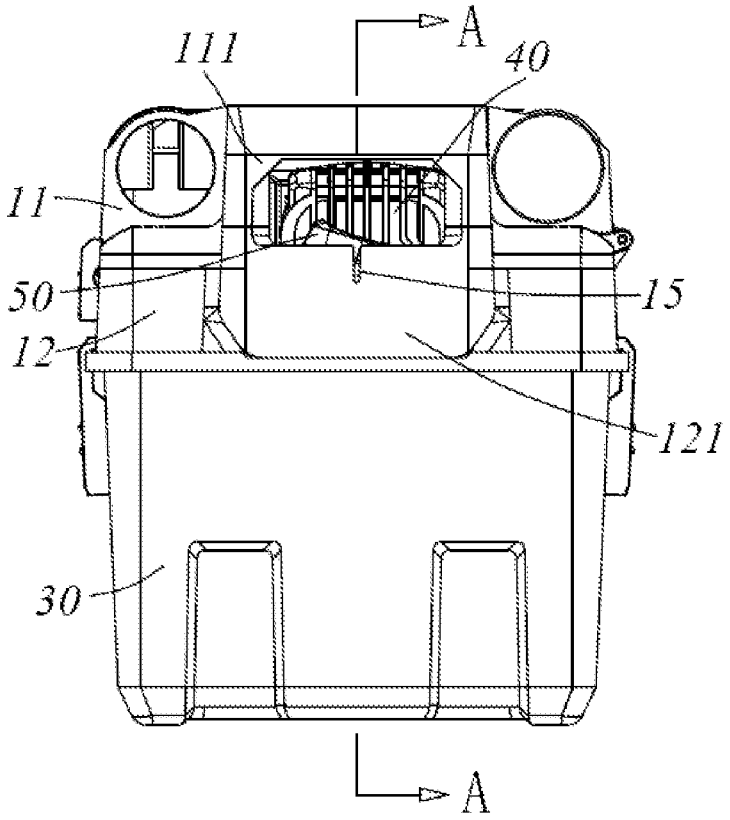
FIG. 4 is a right side view of the vacuum cleaner in FIG. 1.
Figure 5:
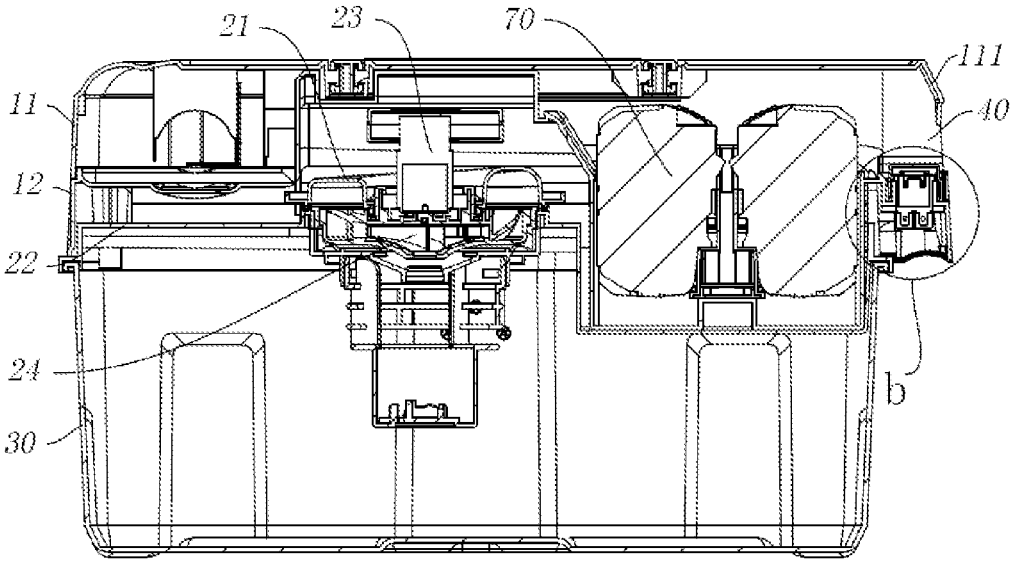
FIG. 5 is a cross-sectional view taken along line A-A of FIG. 4.
Figure 6:
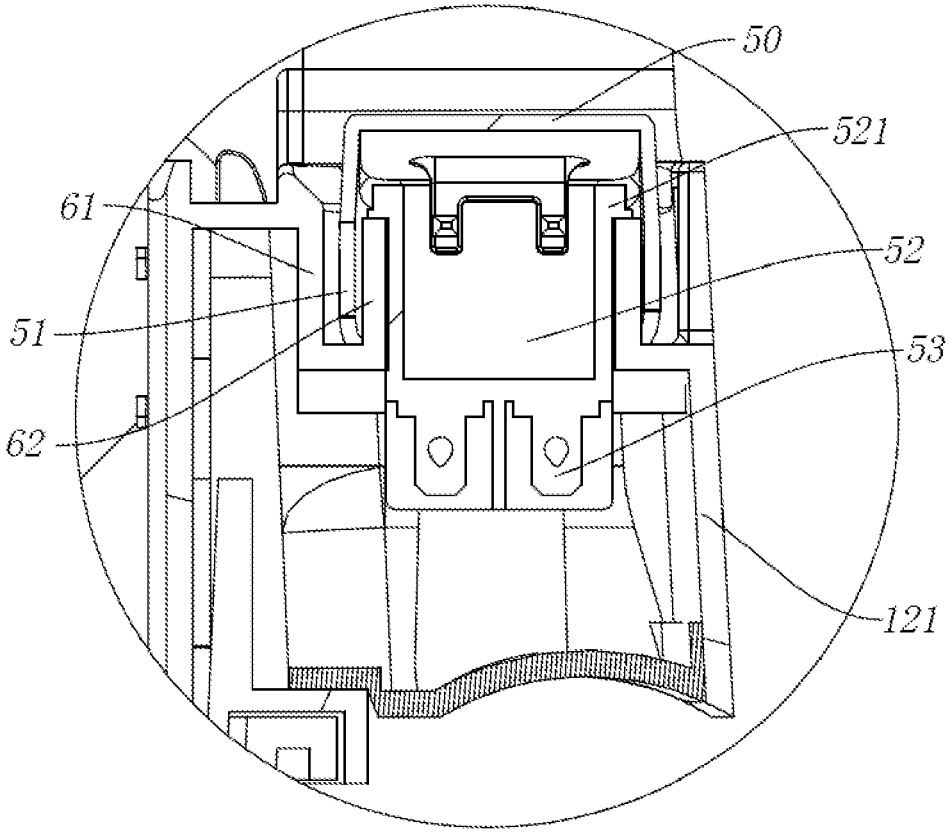
FIG. 6 is an enlarged schematic view of the portion b in FIG. 5.
Figure 7:
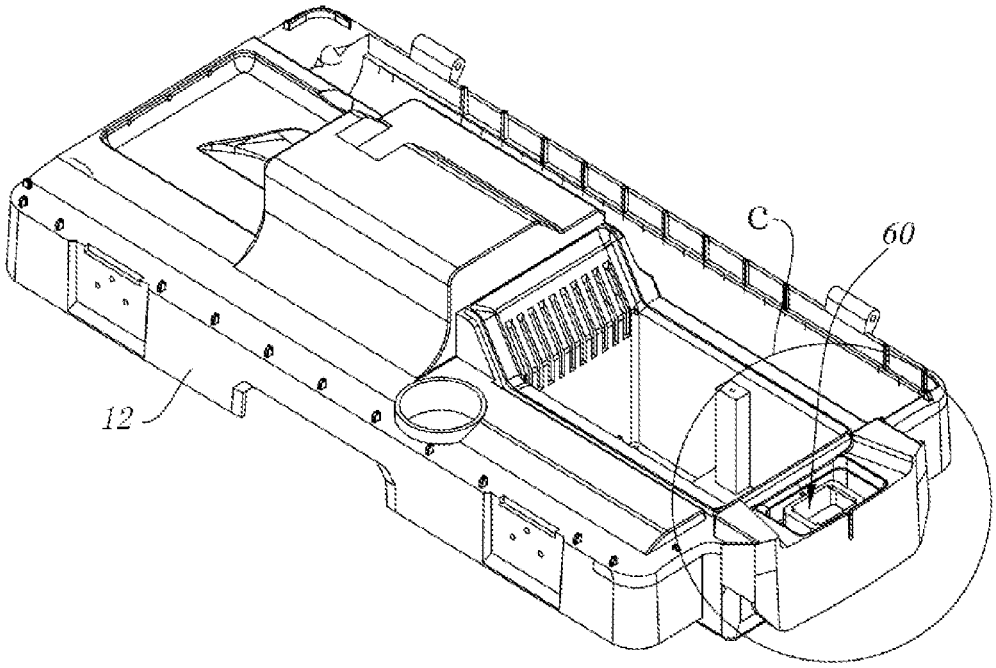
FIG. 7 is a three-dimensional schematic view of the middle cover of the vacuum cleaner in FIG. 1.
Figure 8:
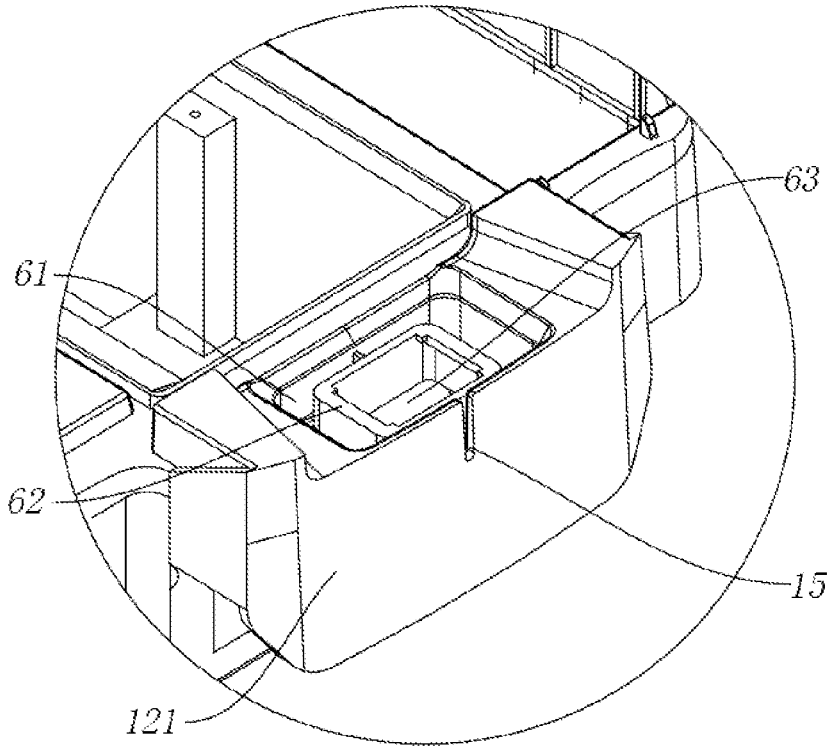
FIG. 8 is an enlarged schematic view of the portion c in FIG. 6.

The present disclosure will be described in detail below in connection with the embodiments shown in the drawings. However, these embodiments are not intended to limit the disclosure. Structural or functional changes based on by those skilled in the art are within scope the present disclosure.

Embodiment 1

A preferred embodiment of the vacuum cleaner of the present disclosure is shown with reference to FIGS. 1 to 8. In the present embodiment, the vacuum cleaner comprises a head assembly, a dust storage barrel 30, and a filter assembly (not shown) connected to the head assembly. The dust storage barrel 30 can be hermetically interlocked with the head assembly by a first clip 31. In addition, a roller can be set under the dust storage barrel 30 to facilitate the movement of the dust storage barrel. The head assembly comprises a housing and a fan arranged in the housing. A hose (not shown) can be connected to the head assembly and an air inlet 14 is arranged in the head assembly. One end of the hose is connected with the air inlet 14 of the head assembly, and the other end of the hose has a suction port which is communicated with the external environment. Under the action of the fan, the external air can pass through the air inlet 14 and be vented after being filtered by the filter assembly, and the filtered dust can fall into the dust storage barrel 30.

The housing comprises an upper cover 11, the upper cover being arranged on the fan, and a middle cover 12, the middle cover 12 being connected between the upper cover 11 and the dust storage barrel 30, the upper cover 11 and the middle cover 12 are hermetically connected by a second clip 32, and the upper cover 11 is also provided with a handle 12 for easy carrying. The middle cover 12 and the dust storage barrel 30 are interlocked to form the internal space of the vacuum cleaner. A lower fan cover 22 is arranged between the middle cover 12 and the dust storage barrel 30, and the lower fan cover 22 and the dust storage barrel 30 are interlocked to form a dust storage space. An upper fan cover 21 is provided between the lower fan cover 22 and the middle cover 12. The upper fan cover 21 and the lower fan cover 22 are interlocked to form an air duct. The fan is arranged in the air duct. The fan comprises a motor 23 and an impeller 24 driven by the motor 23, and the filter assembly is provided at the upstream of the impeller 24. In the present embodiment, the fan is powered by a battery pack 70, and the battery pack 70 is installed between the upper cover 11 and the middle cover 12.

A switch for controlling the fan is provided in the housing. A recessed cavity 40 is provided in the side wall of the housing. A switch trigger 50 for turning on or turning off the switch is provided in the cavity 40. The switch trigger 50 is hidden in the outer contour of the housing and can be operated in the cavity 40. The direction the opening of the cavity 40 faces is roughly the same as the direction the opening of the air inlet 14 faces. Thus, after the user assembles or disassembles the hose and the air inlet 14, it is convenient to switch on or switch off, without the need to go to other sides of the vacuum cleaner. The set of switch trigger 50 to hidden mode greatly reduces the possibility of the false triggering of the switch, so that the use of the vacuum cleaner is safer.

Preferably, in the embodiment, the vacuum cleaner is configured as a toolbox type vacuum cleaner, that is, the overall structure of the vacuum cleaner is in the shape of a substantially rectangular body, he vacuum cleaner has an upper provided with the handle 13, the lower disposed on the ground, the left side provided with the clip and the opposed right side, and the front side and the rear side with respect to the upper and the lower, and the left side and the right side, wherein the cavity 40 is arranged in the front side of the vacuum cleaner, that is, the switch trigger 50 is all shielded by the housing of the vacuum cleaner in the up, down, left, right, and rear directions, only the front side being partially opened. Any part of the switch trigger 50 does not protrude from the outer contour of the housing, and the operator can only actively extend his finger into the cavity 40 from the front to trigger the switch, that is, the cavity comprises an opening in the side wall of the housing, and the direction the opening faces determines that the operator's finger can only extend into the cavity 40 through the opening in the front side to trigger the switch trigger 50, the switch trigger 50 cannot be triggered from the left side and the right side, neither from the upper side and lower side, and there is an angle between the direction in which the switch trigger 50 is triggered to operate and the direction the opening faces, preferably a substantially vertical direction. In the present embodiment, the triggering operation direction of the switch trigger 50 is substantially vertical direction, and the opening in the cavity 40 is in substantially horizontal direction. That is to say, the operator's finger extends from the opening and then applies force to another direction to trigger the switch trigger 50, that is, one action of the extension cannot trigger the switch trigger 50, thereby effectively avoiding false triggering. Furthermore, in a certain situation, for example, when the user needs to operate at a higher position, and there is no tool such as a pedal or a ladder around, the user can step on the toolbox type vacuum cleaner to operate. With the toolbox type vacuum cleaner of the present disclosure, the user does not have to worry about false triggering the switch of the vacuum cleaner when stepping on the toolbox type vacuum cleaner.

Figure 11:
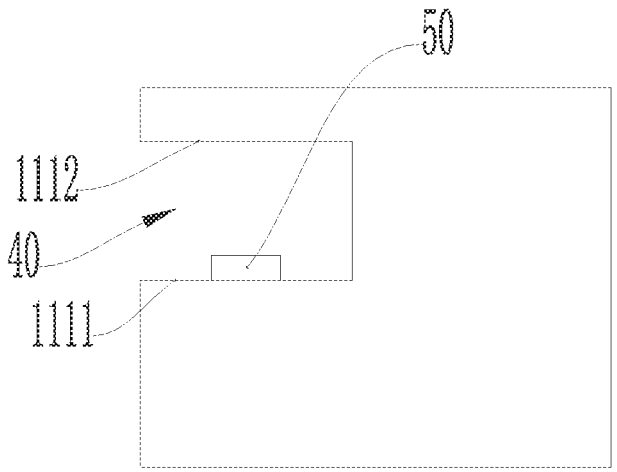
FIG. 11 is a schematic view of the cavity in the first preferred embodiment of the present disclosure.

Further, the upper cover 11 has an upper cover convex edge 111 which is forwardly protruded, and the middle cover 12 has a middle cover convex edge 121 which is forwardly protruded, the recessed cavity is formed between the upper cover convex edge 111 and the middle cover convex edge 121. The switch trigger 50 is configured as a rocker button, and the rocker button is installed in the cavity 40. As shown in FIG. 11, the cavity 40 has a cavity bottom 1111 at the bottom thereof and a cavity top 1112 at the top thereof, the cavity top 1112 being opposed the cavity bottom 1111. In the present embodiment, the extending direction of the cavity bottom 1111 is substantially parallel to the extending direction of the cavity top 1112, thereby defining a cavity 40 with the same cross section shape and the same size of the opening part with those of the inner cavity. A switch seat 60 is provided in the cavity bottom 1111 in the middle cover convex edge 121, and the rocker button is installed in the switch seat 60. The switch seat 60 is configured as a recess on the upper surface of the middle cover convex edge 121, comprises an outer wall 61 of the switch seat and an inner wall 62 of the switch seat, and the inner wall 62 of the switch seat is a through-hole 63 of the switch seat. An annular gap is provided between the outer wall 61 of the switch seat and the inner wall 62 of the switch seat. The side wall and the end wall of the rocker button are provided in the annular gap. The front side of the outer wall of the switch seat 61, that is the front side wall, is provided with a drain hole 15, the drain hole 15 is communicated with the annular gap, so that the water entering between the outer wall 61 of the switch seat and the inner wall 62 of the switch seat can be discharged from the drain hole 15. The switch is disposed in the through-hole 63 of the switch seat, and comprises a switch housing 52 and a switch pin 53, the switch pin 53 being provided at the bottom of the switch housing. The rocker button is disposed at the top of the switch housing 52, the top of the switch housing 52 is provided with an outwardly-protruding housing connection 521, and the housing connection 521 is hermetically matched with the top of the inner wall of the switch seat to prevent water from entering the through-hole 63 of the switch seat, and further to prevent water from seeping into the electric portion of the vacuum cleaner. Of course, the switch seat can also be configured to form a through-hole in the groove, the drain hole is communicated with the groove, and the switch housing and the through-hole are sealed, so as to realize the drainage of the switch seat and prevent the water from seeping into the electrical portion of the vacuum cleaner.

Embodiment 2

Figure 9:
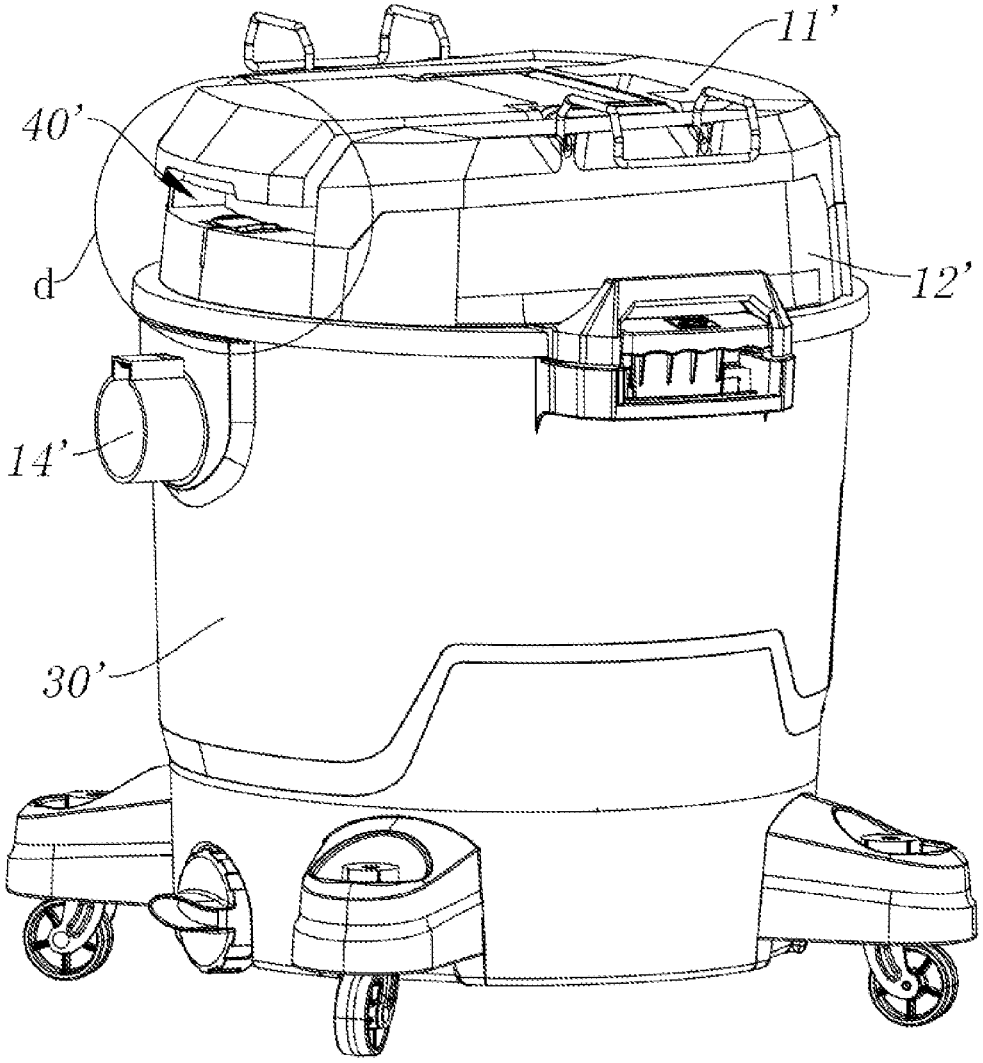
FIG. 9 is a three-dimensional schematic view of a vacuum cleaner in the second preferred embodiment of the present disclosure.
Figure 10:
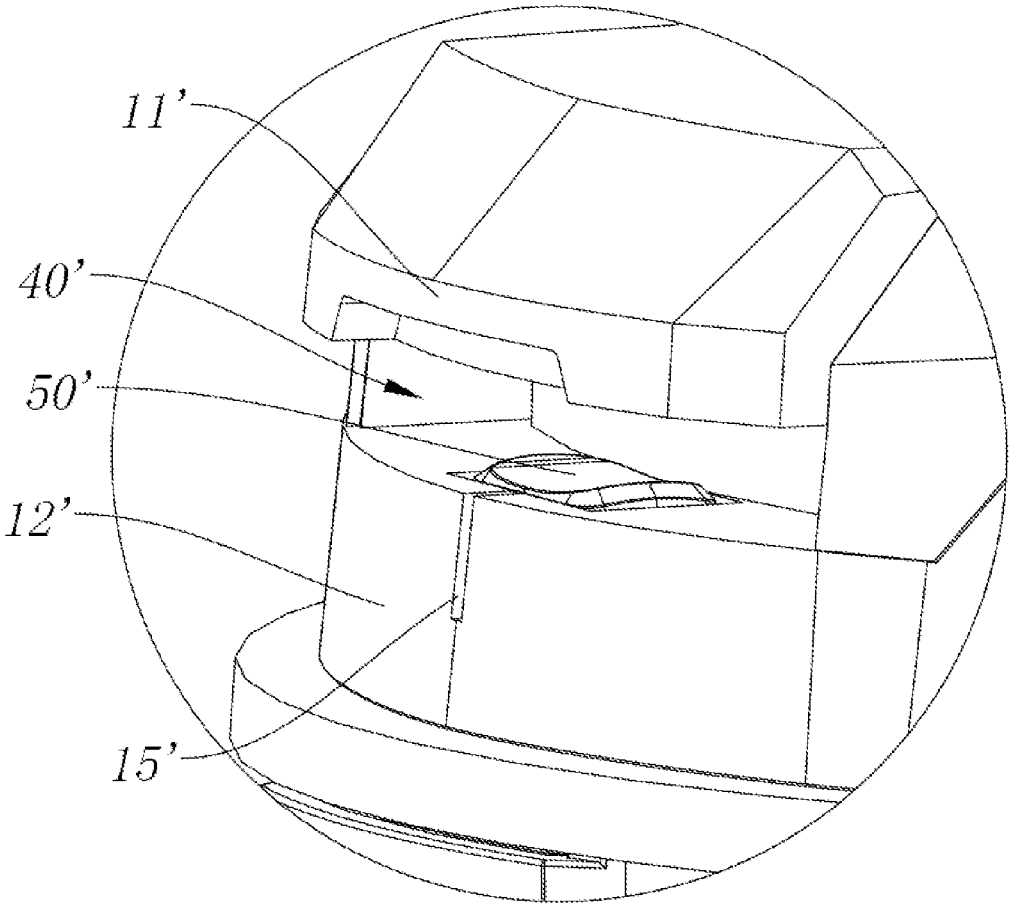
FIG. 10 is an enlarged schematic view of the portion d in FIG. 9.

Another preferred embodiment of the vacuum cleaner of the present disclosure is shown with reference to FIGS. 9 to 10. In the present embodiment, the vacuum cleaner comprises a head assembly, a dust storage barrel 30' and a filter assembly (not shown), the filter assembly being connected to the head assembly, wherein the dust storage barrel 30' is hermetically and detachably connected with the head assembly, and a roller can be set under the dust storage barrel 30' to facilitate the movement of the vacuum cleaner. The head assembly comprises a housing and a fan arranged in the housing. A hose (not shown) may be connected to the dust storage barrel, and an air inlet 14' is arranged in the dust storage barrel 30'. One end of the hose is connected with the air inlet 14' of the dust storage barrel 30', and the other end of the hose has a suction port which is communicated with the external environment. Under the action of the fan, the external air can pass through the air inlet 14' and be vented after being filtered by the filter assembly and the filtered dust can fall into the dust storage barrel 30'. In the present embodiment, the dust storage barrel 30' is configured as a cylinder.

The housing comprises an upper cover 11' covering the fan and a middle cover 12' connected between the upper cover 11' and the dust storage barrel 30'. The upper cover 11' and the middle cover 12' are hermetically connected, and the upper cover 11' and the middle cover 12' are also be configured as an annular matched with the dust storage barrel 30'. A recessed cavity 40' is provided between the upper cover 11' and the middle cover 12'. A switch trigger 50' for turning on or turning off the switch is provided in the cavity 40'. The switch trigger 50' is hidden in the outer contour of the housing and can be operated in the cavity 40'. The direction the opening of the cavity 40' faces is roughly the same as the direction the opening of the air inlet 14' faces. Unlike embodiment 1, the cavity 40' is provided in the circumferential surface of the head assembly. The arrangement of the switch seat and the rocker button on the bottom of the cavity is substantially the same as that of embodiment 1. The middle cover 12 is provided with a drain hole 15' which is communicated with the groove of the switch seat. The slightly difference is that the outer contour of the middle cover is continuous and smooth without obvious convex edge. The basic structure and principle of the vacuum cleaner in this embodiment are the same as those in embodiment 1, and are not described herein again.

Embodiment 3

Figure 12:
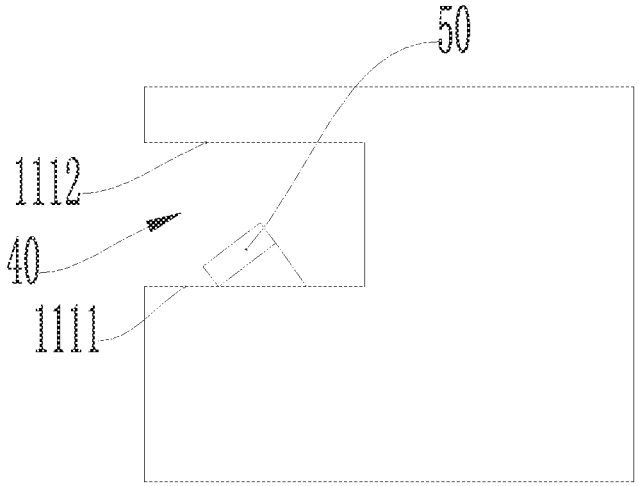
FIG. 12 is a schematic view of the cavity in the third preferred embodiment of the present disclosure.

Referring to FIG. 12, the difference between the present embodiment and embodiment 1 is that the direction in which the switch triggering 50 is triggered to operate inclines towards the opening of the cavity 40. This arrangement not only enables the user to operate the switch trigger 50 more conveniently, but also allows the user to observe the state of the switch trigger 50 more conveniently. Other basic structures and principle of the vacuum cleaner in this embodiment are the same as those in embodiment 1, and will not described herein again.

Embodiment 4

Figure 13:
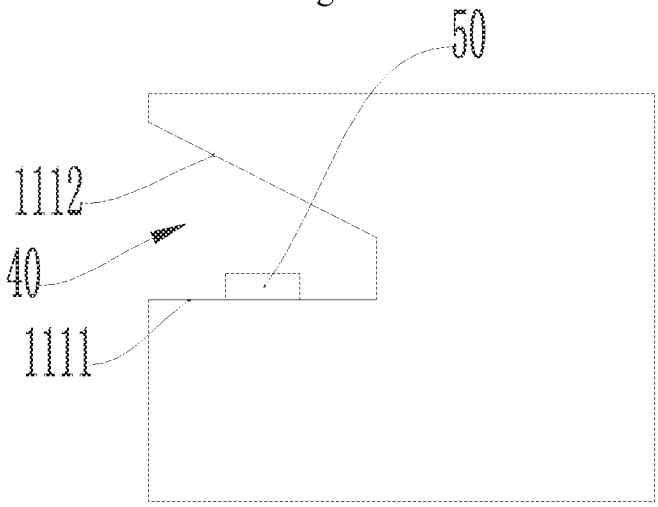
FIG. 13 is a schematic view of the cavity in the fourth preferred embodiment of the present disclosure.

Referring to FIG. 13, the difference between the present embodiment and the embodiment 1 is that the extending direction of the cavity top 1112 is not parallel to the extending direction of the cavity bottom 1111. Specifically, the distance between the cavity top 1112 and the cavity bottom 1111 is larger near the opening of the cavity 40, that is to say, the cavity top 1112 and the cavity bottom 1111 define a cavity 40 with a larger opening and a smaller inner cavity. This arrangement also achieves the technical effect of facilitating the user to operate and to observe the state of the switch trigger 50.

It should be understood that the description is described as the embodiments, but not every embodiment only contains one independent technical solution. The description is only for the sake of clarity. A person skilled in the art should take the specification as a whole, and the technical solutions in various embodiments can also be appropriately combined to form other embodiments that can be understood by those skilled in the art.

A series of detailed descriptions set forth above are merely the specific explanations of the practicable embodiments of the present disclosure, and they are not intended to limit the scope of the present invention. Any equivalent embodiments or changes that were made without departing from the spirit of the present disclosure shall be included within the scope of the invention.

The invention claimed is:

1. A vacuum cleaner comprising:

a head assembly including a housing and a fan arranged in the housing;

a dust storage barrel and a filter assembly arranged below the head assembly, the dust storage barrel being detachably connected to the head assembly;

a switch for controlling the fan located in the housing;

a side wall of the housing having a cavity defined by an opening; and a switch trigger for turning on or turning off the switch located in the cavity so that no part of the switch trigger extends outwardly past an outer contour of the housing;

wherein the cavity has a bottom and a top opposite the bottom, the bottom includes a switch seat, and the switch trigger is mounted in the switch seat; and wherein the switch seat defines a groove for receiving a part of the switch trigger, and the housing defines a drain hole in communication with the groove.

2. The vacuum cleaner according to claim 1, wherein a direction in which the switch trigger is moved to turn off or turn off the switch is at an angle to a direction in which the opening faces.

3. The vacuum cleaner according to claim 1, wherein the housing includes an upper cover arranged on the fan and a middle cover connected between the upper cover and the dust storage barrel, and the cavity is located between the upper cover and the middle cover.

4. The vacuum cleaner according to claim 3, wherein the upper cover has an upper cover convex edge which protrudes forwardly, the middle cover has a middle cover convex edge which protrudes forwardly, and the cavity is located between the upper cover convex edge and the middle cover convex edge.

5. The vacuum cleaner according to claim 3, wherein the upper cover defines an air inlet having an opening facing in a direction the same as a direction in which the cavity faces.

6. The vacuum cleaner according to claim 1, wherein the switch seat is configured as a recess at the bottom of the cavity and includes an outer wall of the switch seat and an inner wall of the switch seat, the inner wall of the switch seat is configured as a through-hole of the switch seat, the switch is located in the through-hole, an annular gap is defined between the outer wall of the switch seat and the inner wall of the switch seat, and the side wall and end wall of the switch trigger are located in the annular gap.

7. The vacuum cleaner according to claim 6, wherein the switch includes a switch housing and a switch pin located at a bottom of the switch housing, the switch housing is located in the through-hole of the switch seat, the top of the switch housing includes an outwardly-protruding housing connection, and the housing connection is hermetically matched with the top of the inner wall of the switch seat.

8. The vacuum cleaner according to claim 6, wherein a front side wall of the cavity defines a drain hole extending from the bottom of the cavity to a bottom of the outer wall of the switch seat and communicates with the annular gap.

* * * * *